US006853301B2

(12) United States Patent
Devine

(10) Patent No.: US 6,853,301 B2
(45) Date of Patent: Feb. 8, 2005

(54) INTERNAL MICRO ALARM

(76) Inventor: James Brian Paul Devine, 24 Knightsbridge Road, Scarborough Ontario (CA), M1L 2B2

( * ) Notice: Subject to any disclaimer, the term of this patent is extended or adjusted under 35 U.S.C. 154(b) by 76 days.

(21) Appl. No.: 10/355,231

(22) Filed: Jan. 31, 2003

(65) Prior Publication Data

US 2004/0061620 A1 Apr. 1, 2004

(30) Foreign Application Priority Data

Sep. 27, 2002 (CA) ..... 2405490

(51) Int. Cl.[7] ..... G08B 13/14

(52) U.S. Cl. ..... 340/571; 340/689; 340/541; 200/61.45 R

(58) Field of Search ..... 340/571, 689, 340/687, 541, 566, 545.1, 545.5, 686.1; 200/61.52, 61.45 R, 61.46; 324/267.17; 73/652

(56) References Cited

U.S. PATENT DOCUMENTS 3,706,867 A * 12/1972 Rand et al. ..... 200/61.52
4,322,714 A * 3/1982 Morgan ..... 340/427
4,884,067 A * 11/1989 Nordholm et al. ..... 340/689
5,675,321 A * 10/1997 McBride ..... 340/568.2
5,926,092 A * 7/1999 Kim ..... 340/571

* cited by examiner

*Primary Examiner*—Anh V. La

(57) ABSTRACT

An electro-mechanical motion sensor for detecting the unauthorized movement of an object and which responds to motion in all axes is disclosed. The sensor comprises a housing having a base, cap and peripheral wall defining the interior of the housing wherein the base and cap have internal and external surfaces with a mid-point thereon and a series of radially extending electrical contacts on the internal surfaces of the base and cap. The contacts extend from about the mid point of the base and cap. A metallic post is located between the mid points on the base and cap respectively and a metallic ball is provided within the housing and is of sufficient size that it can roll freely within the interior of the housing always in contact with the radially extending contacts peripheral wall or metallic post. The metallic ball will tend to come to rest in a position against the metallic post or peripheral wall while touching one or more of the radially extending contacts such that en electrical circuit is formed by contact between the metallic ball and the metallic post or peripheral wall and the radially extending contacts which are all gold plated.

16 Claims, 11 Drawing Sheets

INTERNAL MICRO ALARM

FIELD OF THE INVENTION

This invention relates to security systems and, more particularly, to micro alarm devices designed and integrated onto a computer motherboard or into other valuable electronic devices such as network servers, home entertainment systems, laboratory equipment and weapons.

BACKGROUND OF THE INVENTION

Laptop and palmtop computers allow us to easily carry computing power about and are particularly suited to business people who must often travel. The current explosion of wireless networking will increase the demand for portable computing in the form of laptops and palmtop computers. Laptop computers are targets for theft due to their small size and light weight. New laptops still represent a significant expenditure as they contain the latest in high-speed processors, large RAM and disk memories as well as complex graphics chips advanced LCD displays. The loss of laptop computers can be very costly to individuals and companies. Not only must the laptop be replaced but also valuable time must be spent to reconstruct the lost information. Further, insurance premiums may be affected by continued loss of laptops. According to a Tech Republic survey, 1 in 10 notebooks are stolen and 88% never recovered.

To counter the rapid increase in laptop thefts various inventors have devised several theft deterrent means based on sensing unauthorized motion and then sounding an alert. These inventions are comprised of a motion sensor, alarm speaker, electronic control mechanism and battery source. One type employs a micro-machined polysilicon tilt-motion sensor to detect motion and a speaker to emit an alarm sound. The entire alarm is mounted on a PC Card (a.k.a. PCMCIA Card) that is inserted into the PC Card slot on the laptop. Once armed the alarm monitors any motion of the laptop. If motion exceeds preprogrammed parameters an alarm will sound. An associated software application disables the laptop if it is stolen. This system assumes that someone other than the thief will be present to hear the alarm sound and participate in the interruption of the theft.

Yet another system uses an RF wireless transceiver attached to the laptop. An encoded RF signal is transmitted to a miniature companion transceiver carried by the user. The system can detect if the laptop computer and the user are separated by greater than a predetermined distance and alerts the user to a possible theft. A drawback of this system is the laptop has already been stolen by the time the RF perimeter has been exceeded.

In order to overcome the drawbacks of the prior art systems there is a need for a system that where the laptop is not being otherwise monitored it will still be protected from theft, overcomes problems with delays in response time on sounding of the alarm and prevents the alarm and the laptop from being easily separated.

The present invention has several advantages over the prior art with respect to deterring the theft of a laptop computer or other device. The present invention was designed to attack the hearing sense and confuse the thief. Thus if the occasion arises that the laptop is not being otherwise monitored it will still be protected from theft by the present invention. This is an advantage considering that response time to a perimeter alarm, outside of business hours, may be several minutes. In this time the thief could escape with the laptop undetected. Further, in the prior art, the PC Card housing the alarm can be ejected from the laptop. Once the alarm and laptop are separated the theft deterrent is nullified.

The present invention offers an immediate response to the motion of the laptop being picked up and will force the thief to release it as well. The release of the laptop is predicated on the sensory attack, with an annoyance factor and volume level, designed to force the thief to release the laptop and retreat. If the thief continues to move with the laptop the alarm will persist making the laptop a liability to his successful escape.

Further, in the preferred embodiment an unauthorized user cannot turn off the alarm since it is an inseparable and integral part of the laptop. Continuing to be in unauthorized possession of the laptop with the alarm sounding will be extremely irritating and also draws attention as the thief attempts to escape.

SUMMARY OF THE INVENTION

It is an object of the invention to provide a simple and effective motion detection means.

It is a further object of the invention to provide an alarm device that can be inserted into valuable items that will sound an alarm if the item is moved.

Thus, in accordance with the present invention, there is provided motion detection means adapted for insertion into a moveable object comprising an electro-mechanical motion sensor for detecting the unauthorized movement of an object and which responds to motion in all axes, said sensor comprising a housing having a base, cap and peripheral wall defining the interior of said housing wherein said base and cap have internal and external surfaces with a mid-point thereon and a series of radially extending electrical contacts on the internal surfaces of said base and cap, said contacts extending from about said mid point of said base and cap, wherein a metallic post is located between the mid points on the said base and cap respectively and wherein a metallic ball is provided within the housing and is of sufficient size that it can roll freely within the interior of said housing always in contact with said radially extending contacts, peripheral wall and/or post wherein said ball will tend to come to rest in a position against said post or peripheral wall while touching one or more of said radially extending contacts such that an electrical circuit is formed by contact between said ball and said post or peripheral wall and said radially extending contact wherein the radially extending contacts, peripheral wall, post and metallic ball are 24 karat gold plated.

In another embodiment the present invention provides An alarm means for detecting the unauthorized movement of an object, wherein said alarm means is located on laptop (or desktop) computer motherboard or otherwise located internally to a computer, TV, HDTV, VCR, video recorder, audio home entertainment system or similar valuable electronic equipment said alarm means comprising:

(a) a motion detection means comprising an electro-mechanical motion sensor for detecting the unauthorized movement of an object and which responds to motion in all axes, said sensor comprising a housing having a base, cap and peripheral wall defining the interior of said housing wherein said base and cap have internal and external surfaces with a mid-point thereon and a series of radially extending electrical contacts on the internal surfaces of said base and cap, said contacts extending from about said mid point of said base and cap, wherein a metallic post is located between the mid points on the said base and cap respectively and wherein a metallic ball is provided within the housing and is of sufficient size that it can roll freely within the interior of said housing always in contact with said radially extending contacts, peripheral wall and/or post wherein said ball will tend to come to rest in a position against said post or peripheral wall while touching one or more of said radially extending contacts such that an electrical circuit is formed by contact between said ball and said post or peripheral wall and said radially extending contact wherein the radially extending contacts, peripheral wall, post and metallic ball are 24 karat gold plated;

(b) a programmable control microprocessor, to detect when said electrical circuit is formed by said peripheral wallor post, ball and any radially extending contact and to detect when said circuit is broken by movement of the object;

(c) an audible alarm means wherein said audible alarm means emits a sound oscillating between at least two frequencies and at a volume of about 120 dBs when said electrical circuit is broken and wherein the alarm means is preferably a piezo-electric siren; and (d) a rechargeable battery and wherein the said microprocessor, rechargeable battery, alarm means and motion detection means are mounted on a circuit board.

When the object is moved while the alarm is the armed state the audible alarm means sounds when said electrical circuit is broken. In order to act as an effective deterrent the audible alarm means is preferably a piezo siren.

The alarm can be inserted into valuable items such as televisions, digital televisions, HDTV's (High-Definition Televisions), audio home entertainment systems, VCR's, computers etc. When armed it will detect motion of the item in which it is inserted and will sound an alarm if the motion exceeds the preprogrammed limit. It is further envisioned that the remote control keypads for such devices could act as the input means for adjusting the detector parameters as well as arming and disarming the alarm.

The concept is to integrate the entire alarm (with the possible exception of the piezo siren) onto the laptop motherboard. The alarm is designed to run as an autonomous system when the laptop is powered down. The alarm is connected to the laptop motherboard via a system bus. Power will come from a rechargeable battery when the laptop is powered down. The microcontroller will remain in low-power mode while it monitors the alarm sensor for unauthorized movement.

The sensor is also envisioned to be packaged as a self-contained component that can be soldered or otherwise mounted to a printed circuit motherboard. The component would consist of a miniature ceramic or fiberglass printed circuit board with the following components mounted thereon: motion-detector, piezo driver, microcontroller and associated electronics and battery. The component would have metal mounting pads or leads allowing it to be soldered to a printed circuit motherboard. The component variant would be compatible with pick and play machines for assembly purposes.

Further features of the invention will be described or will become apparent in the course of the following detailed description.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
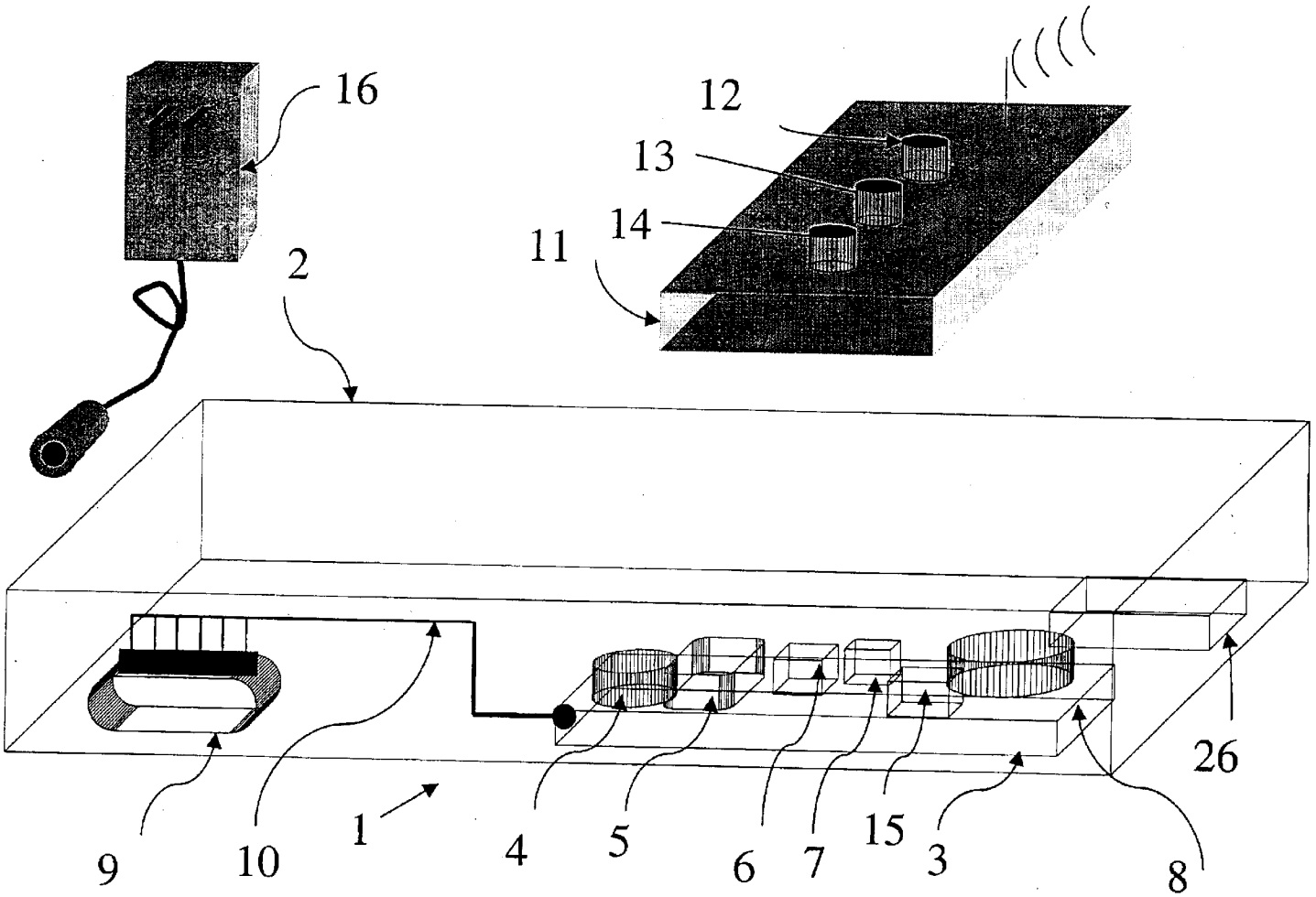
FIG. 1 is a schematic perspective of an embodiment of an internal micro alarm of the present invention mounted on a PCB within a laptop computer together with remote control.
Figure 2:
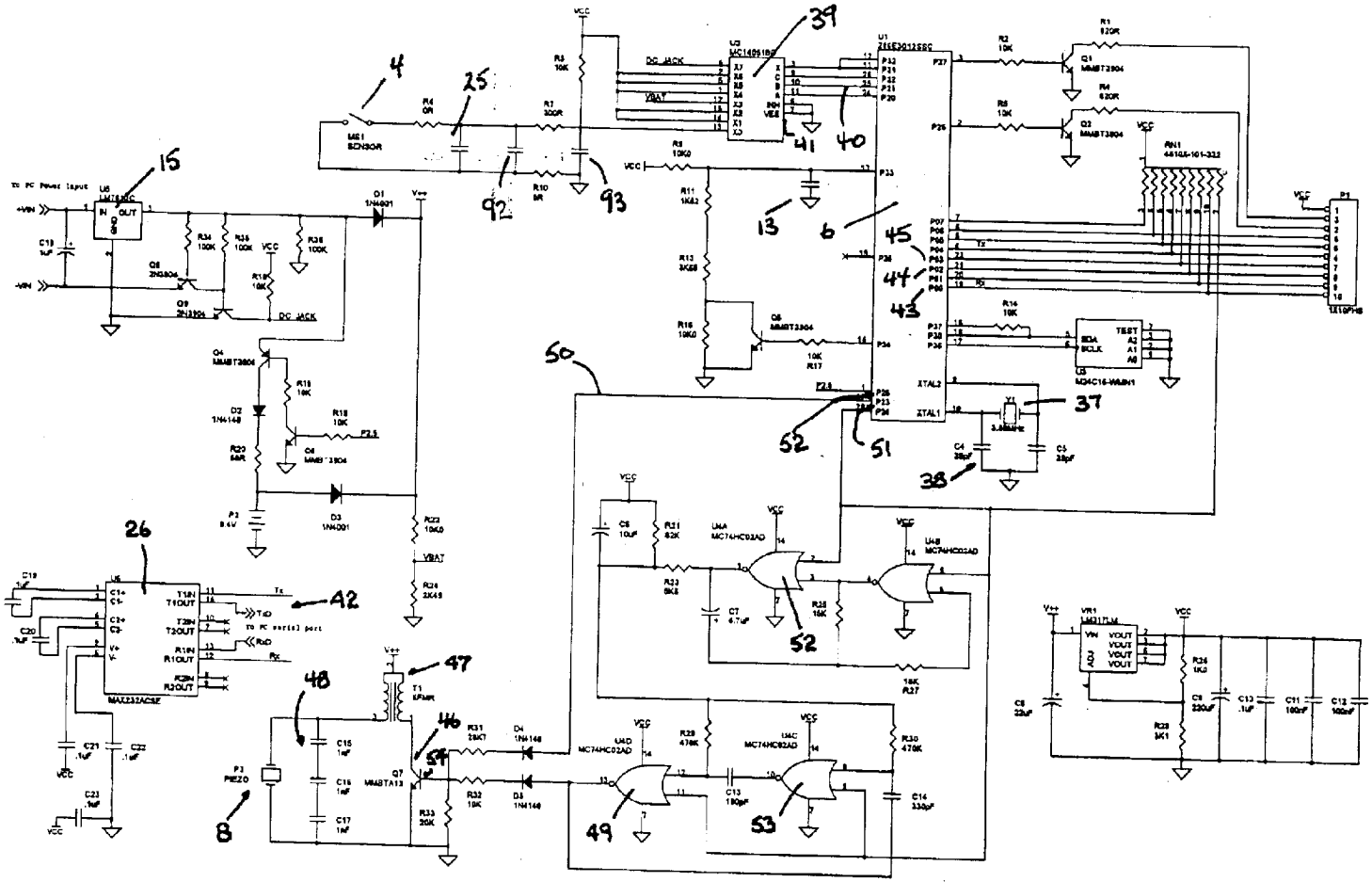
FIG. 2 is a circuit diagram for the internal micro alarm of FIG. 1.

With reference to FIGS. 1 to 8, an embodiment of the internal micro alarm according to the present invention, generally indicated at 1, is shown placed into a laptop computer 2. In FIG. 1, the internal alarm 1 is shown mounted on a printed circuit board (PCB) 3. Rather than be mounted on a separate PCB, the alarm circuitry can be integrated onto the laptop motherboard. The advantage of direct mounting to the motherboard of the laptop is that it cannot be removed like other alarm systems that are attached in some fashion to the exterior of the laptop. The internal alarm 1 consists of motion sensor 4, rechargeable battery 5, microcontroller 6, alarm driver 7 and piezo alarm 8. Communication between the alarm microcontroller 6 and the laptop operating system is established in FIG. 1 by internally connecting the RS-232 port 9 of the laptop 2 with fly leads 10 to the PCB 3. As previously noted the alarm electronics can alternatively be included on the PC motherboard or be interfaced to the system CPU via the ISA or PCI bus. The alarm could use any other port including parallel, USB, memory, video, Bluetooth or future high-speed serial connections. In the present invention battery power is supplied from a rechargeable 9-volt NiCd battery 5 mounted on PCB 3. The battery 5 is recharged through a regulator 15 mounted on the PCB 3. As shown in FIG. 2, the regulator 15 preferably receives current from the laptop battery-eliminator 16. In this way the alarm can remain enabled regardless of whether the laptop is powered up, powered down or during the boot or closing sequence.

Figure 4:
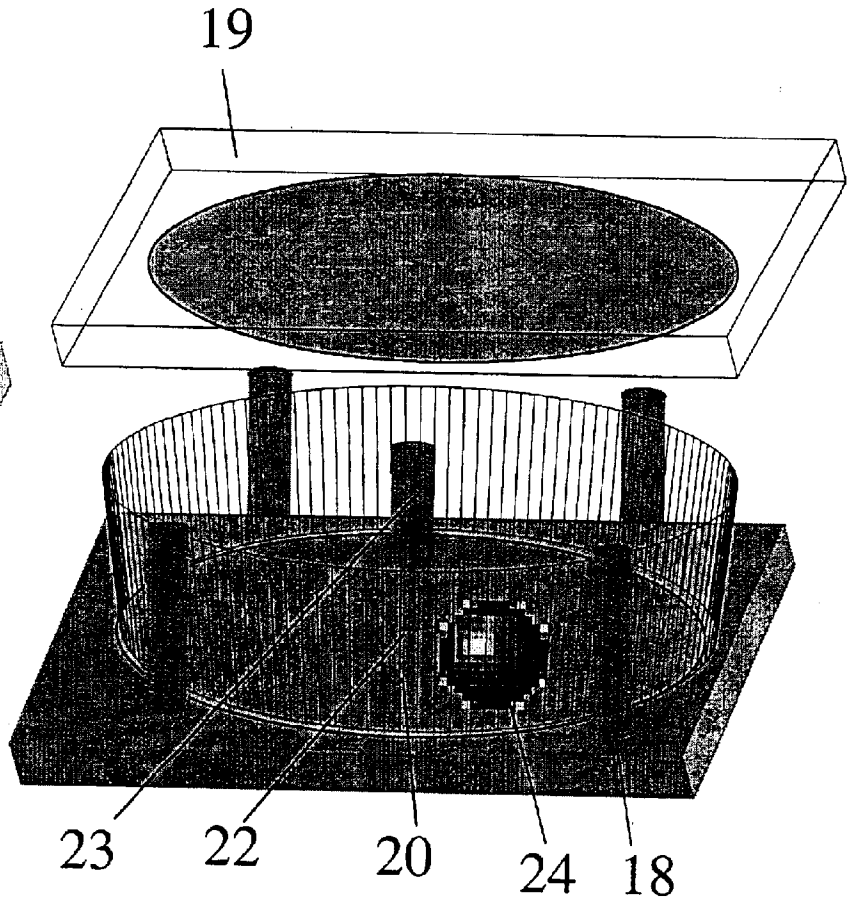
FIG. 4 is a schematic representation of the inside of the motion sensor of FIG. 3.
Figure 3:
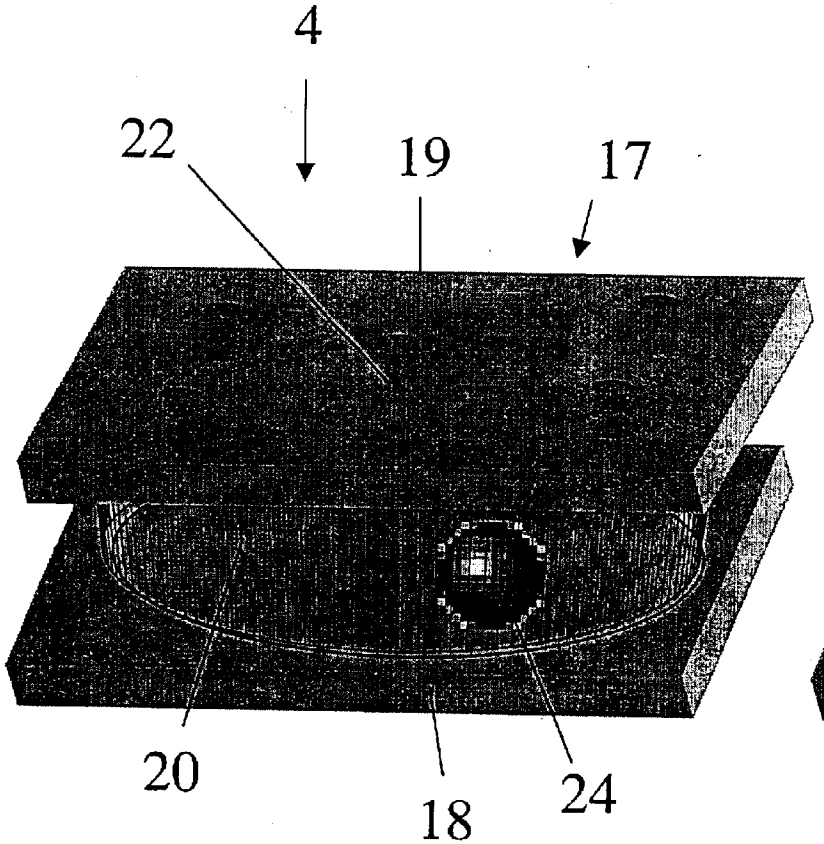
FIG. 3 is a schematic perspective view of an embodiment of a motion sensor for use with the internal micro alarm of FIG. 1.
Figure 5:
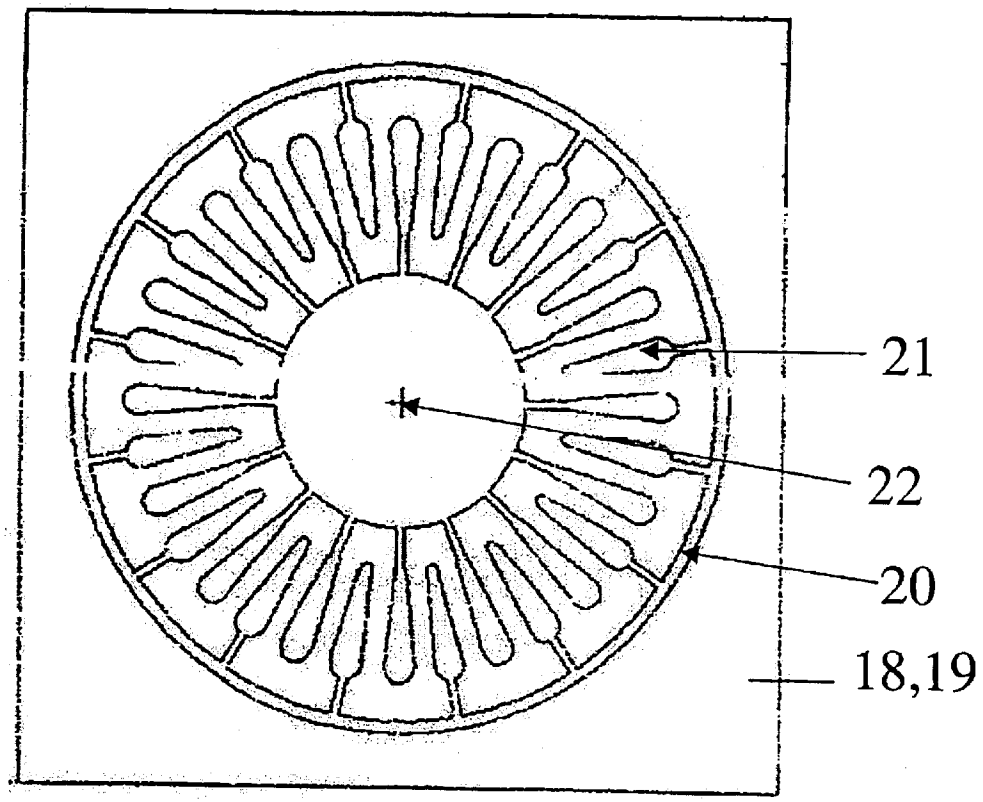
FIG. 5 is a schematic representation of one embodiment of the pattern for the contact points on the base and cap of the motion sensor of FIGS. 3 and 4.

One embodiment of the motion sensor 4 of the present invention shown in FIGS. 3–5 consists of a housing 17 having a PCB base 18, PCB cap 19 and peripheral wall 20.

The housing 17 shields the motion sensor from outside interference such as magnetic fields etc. A series of radially extending electrical contacts 21 on the inside surface of PCB base 18 and PCB cap 19 extend from about the mid point 22 of PCB base 18 and PCB cap 19. A metallic post 23 is located between the mid points 22 on PCB base 18 and PCB cap 19 respectively. Metallic ball 24 is provided within the housing and is of sufficient size that it can roll freely within the interior of housing 17 always in contact with contacts 21 and/or post 23. Ball 24 will tend to come to rest in a position against post 23 or wall 20 while touching one or more of contacts 21. The control program of the alarm detects when an electrical circuit is formed by post 23 or wall 20 and ball 24 and any contact 21 and detects when this circuit is broken.

As shown in FIG. 2, capacitors 25 serve to reduce switch "chatter" as the ball 24 makes and breaks contact with the radially extending electrical contacts 21. Motion is detected by counting the number of pulses generated by the ball 24 as it makes and breaks contact with the radially extending electrical contacts 21.

The microcontroller 6 is programmed with a software routine that allows for control of the motion sensor sensitivity. The software routine counts the number of pulses that occur in a given period. If the number of pulses in this period exceeds a pre-selected value then the microcontroller 6 moves to an "alarm" state. The microcontroller 6 has eight bins that are used to count the pulses. The bin count is incremented each time the ball 24 makes or breaks a connection. Only one bin is active at a time. At the end of a specified time, the counts in all eight bins are analyzed. For each sensitivity setting there are corresponding limits. Firstly, there is a time period in seconds that represents how long a specified bin can continue to count pulses. Secondly, there are upper and lower limits for the number of increments allowed. Counts outside these limits are rejected by the software routine. Next there is a limit on the number of bins that can be rejected. Finally a "trigger threshold" is specified which is related to the sum of the count in all eight bins. If the threshold limit is exceeded then the microcontroller executes the alarm routine. Table 1 shows the preferred values used in one embodiment of the present invention.

| Sensitivity Setting | Time/Bin (seconds) | Reject Limit (max) | Reject Limit (min) | Number of Bins to Reject (max) | Trigger Threshold |
|---|---|---|---|---|---|
| 1 | 0.12 | 24 | 9 | 4 | 70 |
| 2 | 0.12 | 24 | 8 | 4 | 60 |
| 3 | 0.12 | 24 | 7 | 3 | 50 |
| 4 | 0.10 | 20 | 5 | 3 | 35 |
| 5 | 0.10 | 20 | 4 | 3 | 22 |
| 6 | 0.10 | 20 | 3 | 4 | 18 |
| 7 | 0.10 | 20 | 3 | 4 | 13 |
| 8 | 0.10 | 20 | 3 | 4 | 9 |
| 9 | 0.03 | 6 | 3 | 4 | 7 |

The values listed in Table 1 were arrived at by empirical means. Representative motions of lifting and walking with objects were analyzed to derive sensitivity values. Other values can be used without departing from the scope of the present invention.

To extend the service life of the sensor 4 it was found that the ball 24, post 23, wall 20 and contacts 21 should be 24 karat gold-plated. This passivates all contact surfaces within the sensor. Without passivation the metal ball 24 reacts with the wall 20, post 23 and contacts 21. Deposits form which impair the performance and reduce the service life of the alarm. An even plating thickness of not less than 0.00057 inches is preferably used for the ball and associated contact surfaces. All electrical joints were made with resin-core solder to prevent oxidization. Cleaning with 100% acetone, which leaves no residue, is recommended. In addition the assembly is pressurized with dry-nitrogen gas to further reduce electro-mechanical reactions from spoiling the contact surface. The entire outside of the assembly was sealed with conformal-coat lacquer containing a mildew inhibitor. These steps provide for a clean environment within the sensor assembly thus minimizing corrosion.

The motion sensor 4 can be placed in any orientation and will still respond to any attempt to move the device. Since the sensor 4 is built in a sandwich style having radially extending contacts 21 on the PCB Base 18 and PCB cap 19 it is able and has been demonstrated to react to motion in all axes. As soon as an imbalance in the X-Y axes (and by inference the Z axis) is detected the motion sensor 4 will signal an alarm state. The internal tolerances are designed such that the usual motion of seizing and lifting a moveable object to which the detector is attached will cause the ball 24 to roll creating sufficient switch contacts to be made and broken that the microcontroller program will move to an "alarm" state. When the alarm is in the armed condition, the control program detects and counts the instances of a break of the electrical circuit. The sensitivity of alarm 1 can be adjusted preferably by two methods: first, by adjusting the frequency of movement checks by the program and second by adjusting the count number required to trigger alarm 1. If there is any attempt to move the laptop without authorization the alarm will recognize this type of motion and cause the piezo siren 8 to sound at an ear piercing level, preferably of 120 dBs.

In the present invention, the preferred motion sensor 4 is an electro-mechanical mechanism, which responds to motion in all axes. The sensor 4 is simple and robust and has advantages over other sensor technologies. The motion sensor of the present invention can be manufactured by conventional PCB, electro-plating, soldering and mechanical assembly methods. Other motion-sensors (accelerometers) require the use of specialized semiconductor fabrication equipment as well as micro-machining methods. This results in expensive set-up times and limited sources. The motion sensor herein described can be assembled inexpensively with moderate technology means. The motion sensor can be manufactured in any developed country. Due to its robust construction, the motion sensor, when properly mounted, can easily survive a severe mechanical and thermal shock and remain operational. Furthermore the motion detector does not require electronic calibration or complex stability compensation, as do semiconductor-based devices. The motion sensor consumes little power (~360vA). Motion sensor 4 of the present invention measures 0.65"×0.65"×0.05". This was determined to be a suitable component size for insertion into a laptop computer. It is possible to reduce the size of the motion sensor to meet specific applications. The parameters to be considered in this case are: diameter and weight of the metallic ball, diameter and height of the peripheral wall, the number of radially extending electrical contacts, angular distance between the radially extending electrical contacts and the copper weight of the PCB traces. Also, adjustments may have to be made to the microprocessor's sensitivity subroutine.

The motion sensor 4 described herein has advantages over the recent polysilicon micro-machined technology (known as MEMS, MicroElectroMechanical Systems). MEMS technology is a combination of micro-mechanical and semiconductor technology requiring a very expensive semiconductor fabrication facility in order to produce the parts. Further, due to inconsistencies in manufacture each device generally is accompanied by detailed calibration information stored in a companion PROM. Temperature compensation is often required as well. Lastly, the MEMS devices require circuit balancing in the form of a Wheatstone bridge. By contrast the motion detector of the present invention uses very little power and can be easily interfaced to any microprocessor or gate array. Three capacitors are recommended for filtering and further filtering and sensitivity setting can be accomplished in a simple software counter scheme. The motion-sensor can operate in an atmosphere of moderate conducted and radiated emissions. Signal output level is also easily matched to other applications.

Historically, mercury tilt-switches were used to detect motion (e.g. pinball tilt sensors). Generally it is difficult to assign a calibration factor to these switches as they are either in an on or off state. Ganging several mercury tilt-switches together to accommodate different axes is possible but tedious in design. Further, disposal of the toxic mercury become a problem when the device is at the end of its service life.

Figure 6:
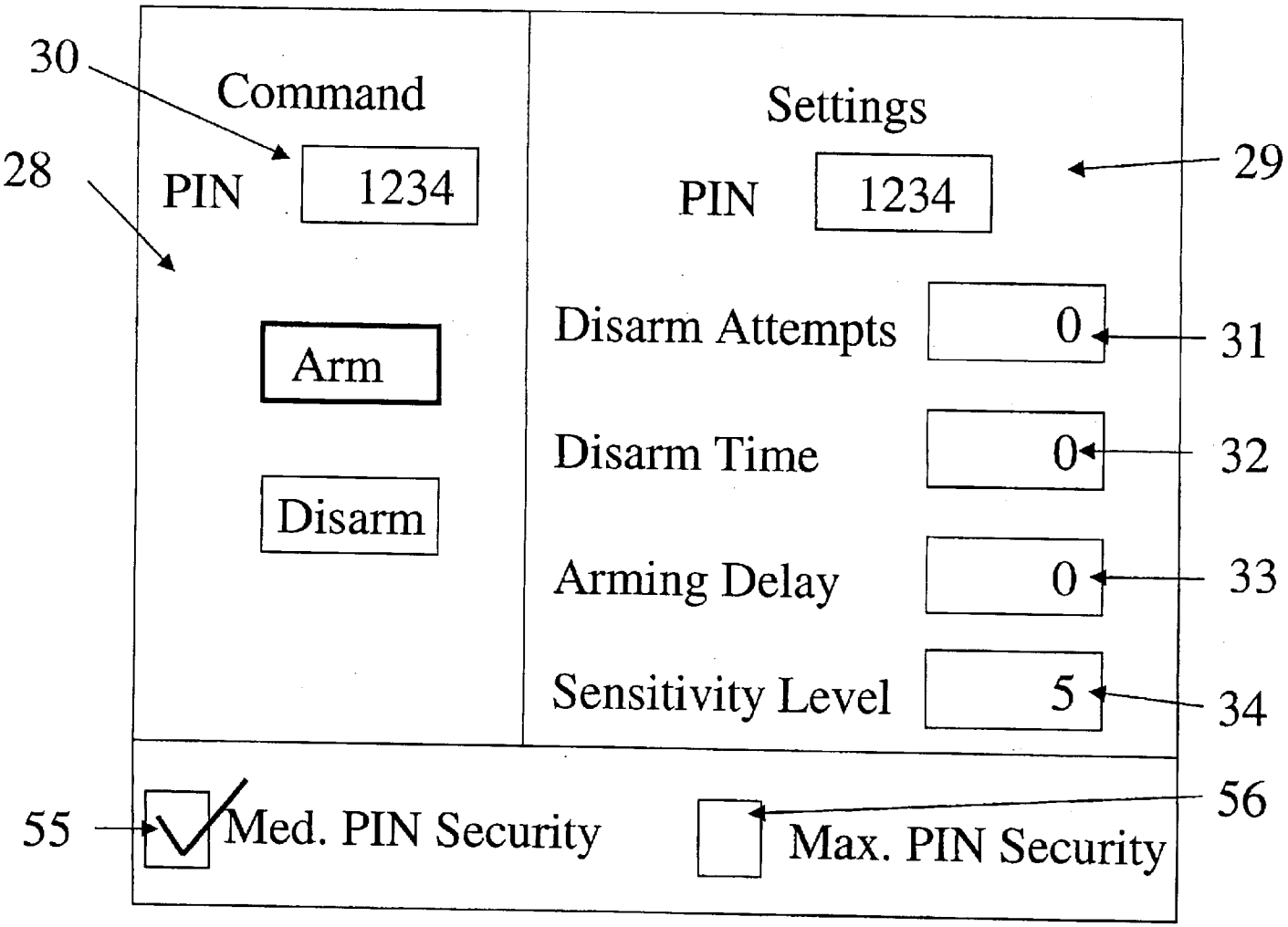
FIG. 6 is a schematic representation of the graphical user interface of the internal micro alarm of FIG. 1.

In order to adjust the various parameters of the internal micro alarm, a software GUI (Graphical User Interface) is provided and implemented in the preferred embodiment under the Windows operating system although other operating systems are possible such as MacIntosh etc. A schematic representation of a preferred GUI is shown in FIG. 6. The alarm can be configured, armed and disarmed via the Windows GUI. This allows the user to select a private PIN (Personal Identification Number) with which to enable and disable the alarm. The motion sensor sensitivity can be adjusted by the user to suit the particular environment. The motion sensor has been designed by using empirical data to reject bumps but to respond to being lifted. The response of motion the motion sensor can therefore be tailored to the user's specific application.

In the embodiment shown in FIG. 1, the laptop alarm can also be activated or deactivated by means of RF remote control 11. The alarm is activated by pressing switch 12 and deactivated by pressing switch 13. A further feature is that if the user desires he may instantly silence the alarm from alert state (piezo sounding) by pressing the switch 13. Pressing switch 14 instantly causes the alarm to sound for 10 seconds after which the system returns to an armed state. This mode was devised as a "panic button" to allow the user to interrupt a theft in progress. The "panic mode" preferably can be used to locate the laptop within a radius of approximately 100 feet. A commercially available three-function RF transmitter 11 was used to send commands to an RF receiver 26 (designated as RR1 in FIG. 2). The receiver and transmitter operate at a carrier frequency of 418 MHz in the North American unlicensed frequency band. The transmitter is preferably FCC Part-15 compliant. For prototyping purposes the receiver 26 was located adjacent to the alarm PCB and interfaced to the microcontroller 6 via a general purpose interface port.

It is estimated that conventional laptops take between 2 and 5 minutes to completely "boot". The authorized user may find it cumbersome to wait for the laptop to boot and then enter the correct PIN number to silence the alarm once tripped. The RF remote control 11 allows the convenience of arming or disarming the alarm whether or not the laptop is powered up with access to the GUI.

The GUI also preferably features an auto-arm mode based on a history of the user's habit of arming the alarm. This is based on the time of day, day and frequency or arming. The PC software records the time of all arming and establishes a database of these events. A fuzzy-logic algorithm then determines appropriate times to arm the laptop. In this way, if the user forgets to set the alarm after midnight for example the alarm will automatically move into an armed state. The alarmed state will be evident by a flashing LED (not shown).

The GUI features a tamper-proof PIN number. The PIN number is used to identify an authorized user. The GUI is separated into two screens 28, 29. The left-hand side 28 of the screen accepts to arm/disarm command by way of entering a valid PIN number 30. The right-hand side 29 of the screen allows the sensor parameters to be changed. However, entering the same PIN number previously entered on the left-hand side must precede any changes to the sensor parameters. If a second party has changed the PIN number on the right-hand side, then re-entering the original PIN number on the left side, will alert the user to a potential security breach since they will be unable to change any of the alarm settings. All program changes are permanent unless the original PIN number is entered.

The following describes the settings used in the preferred embodiment described herein, however all settings are user selectable and can be stored in the microprocessor memory. The selections of alarm settings are as follows:

Disarm Attempts
Disarm Time
Arming Delay and
Sensitivity Level.

The "Disarm Attempts" 31 function counts the number of times a PIN number is unsuccessfully entered. While armed, touching any key on the laptop keypad (not shown) will initiate a sequence, which records the number of attempts. Once the user assigned number of attempts is exceeded the alarm will sound. Disarm attempts are programmable from 1 to 9 times.

The "Disarm Time" 32 preferably has two functions. It allows the setting of a time within which the sensor can be moved without the alarm sounding. For example, if the "Disarm Time" were set to 5 seconds, the user would have 5 seconds to move the protected object about without causing the alarm to sound. This is helpful if the user wishes to set the alarm and then store the object in a locker. Setting the "Disarm Time" also has the effect of delaying the onset of the alarm by the same time period should the protected object be moved. This has a perimeter alarm effect as in this example the alarm will not sound until 5 seconds after the protected object is disturbed. If the thief is moving with the protected object he will leave the immediate area only to have the alarm sound 5 seconds later.

The "Arming Delay" 33 sets the period within which the PIN number must be entered. Periods from 1 to 1200 seconds are possible.

The "Sensitivity Level" 34 adjusts the sensor sensitivity. Selecting a number between 1 and 9 where 1 is least and 9 is most sensitive sets the sensitivity of the sensor to motion. The sensitivity variable permits the detector to be adapted to a particular environment. Lower sensitivity matches an environment where the protected object will encounter occasional light shock or vibration. Regardless of the sensitivity level selected, the alarm will still respond if the protected object to which the alarm is attached is seized and lifted.

As shown in FIG. 2, the control element of alarm 1 is microcontroller 6. The preferred embodiment uses the Zilog Z86E30 low-power microcontroller that has two timers and programmable input and output channels. Other embodiments may use other microprocessors to provide different features other than those described in this invention.

Microcontroller 6 monitors the signals from the keyboard of the computer, motion sensor 4 and remote control 11. Piezo siren 8 is also controlled by the microprocessor. As shown in FIG. 2, crystal 37 and capacitors 38 generate the clock signal for micro controller 6. For clarity, ancillary components such as noise filtering capacitors and pull-up resistors are not described herein.

Motion sensor 4 and battery 5 are connected to microcontroller 6 through multiplexer 39. Multiplexer 39, in the embodiment shown, is a commercially available MC14051 component. Data lines 40 of microcontroller 6 are connected to control lines 41 of multiplexer U2, thereby enabling microprocessor 6 to control the output of multiplexer 39. Signal lines 42 of the RF Receiver 26 are connected to the general-purpose interface pins 43, 44, 45 of microcontroller 6.

The circuit formed by transistor 46, transformer 47 and capacitors 48 drives Piezo 8. Transistor 46, in turn, is driven thru gate 49 from output lines 50 and 51 of microcontroller 6. Gates 52, 53, 49 are configured as an oscillator to provide a particular audio frequency sweep that is described later herein. Output line 50 of microcontroller 6 is also connected to the base 54 of transistor 46 allowing a muted Piezo sound burst. This burst is used provides an audible confirmation that the alarm has been armed or disarmed via the remote control 11 (one burst signifies armed and two bursts for disarmed).

Figure 7:
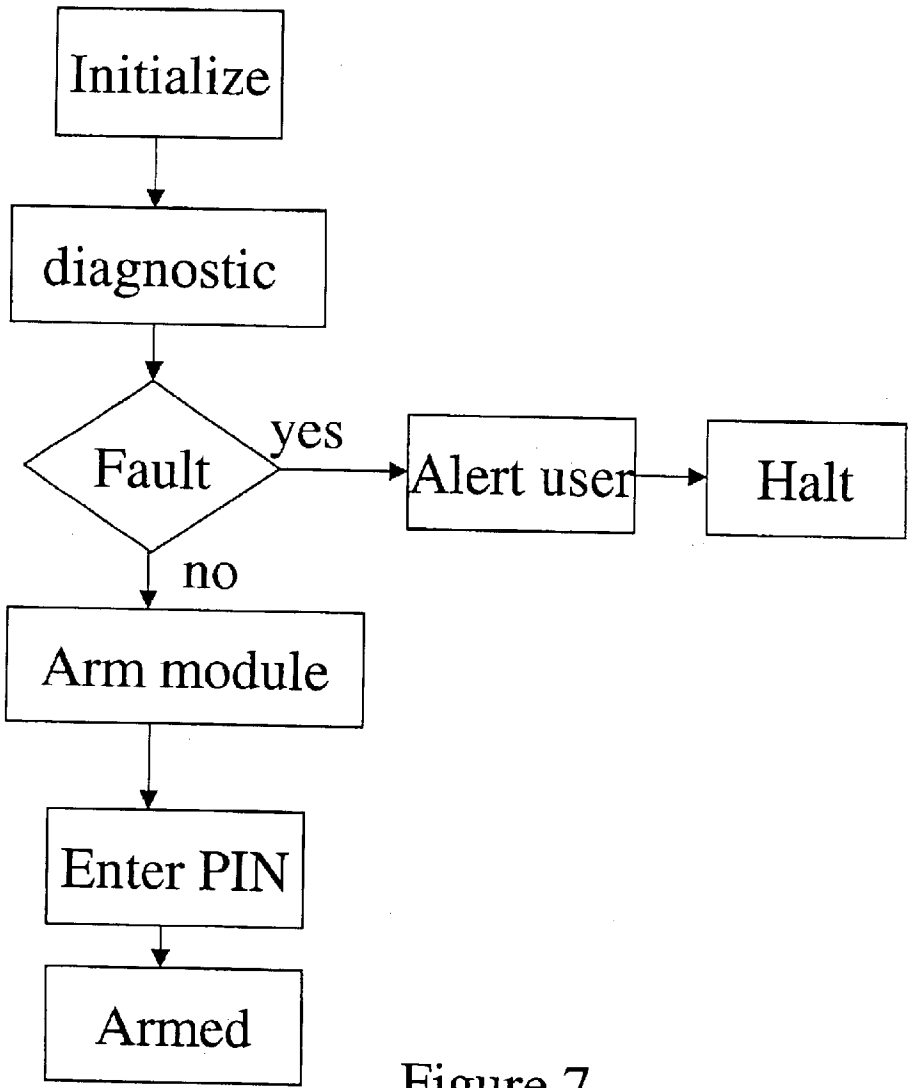
FIG. 7 is a flow diagram showing an embodiment of the initialization, unarm, arm modules of the internal micro alarm of FIGS. 1 and 2.
Figure 8:
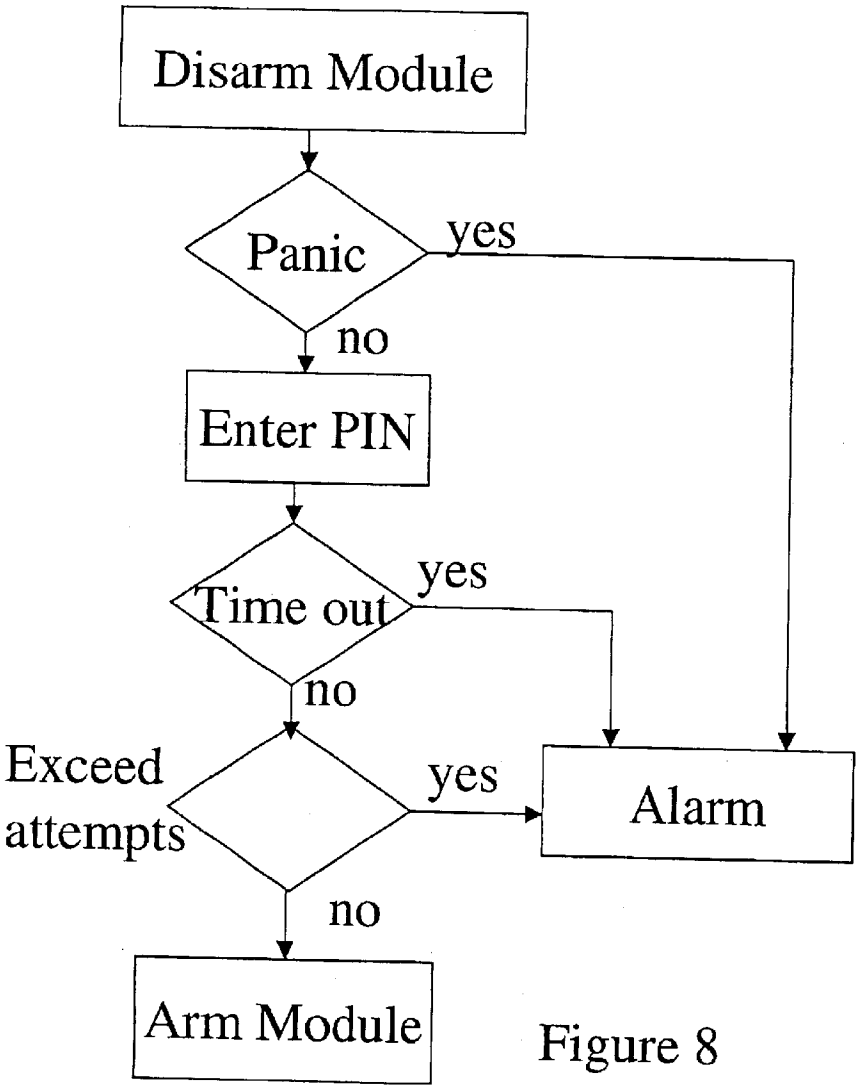
FIG. 8 is a flow diagram showing an embodiment of the disarm module of the internal micro alarm of FIGS. 1 and 2.

The program contained within the microcontroller 6 controls all functions of alarm 1. The flowchart of the program is shown in FIGS. 7 and 8 and comprises the following modules: Initialization, Unarmed, Armed, Disarmed and Alarm. Each module is described in turn.

The Initialization module is executed by the microcontroller when alarm 1 is turned on. This module resets all internal program variables used by the microcontroller and executes diagnostics for certain electrical components, including the internal memories of the microcontroller The Unarm module executes after the Initialization module passed all internal tests. In the unarm state the microcontroller waits for a PIN number entry in order to enter the armed state or for the user to change the detector and general alarm settings.

In the Armed module, alarm 1 can either sound the piezo or enter the Disarm module. The alarm can be set to "Armed" in two ways. Firstly, the user can enter an authorized PIN into the left hand side of the GUI. After an authorized PIN has been entered a user selectable "Disarm Time" transpires (0–10 seconds) after which the alarm is armed. Alternatively, switch 12 on the remote controller 11 can be depressed which initiates the Armed module.

In the Disarm module, alarm 1 can be disarmed. However, if alarm 1 is unsuccessfully disarmed, the program returns to the Alarm module. The user must enter an authorized PIN in order to disarm the alarm 1. Failure to enter an authorized PIN within a set time will cause the alarm to sound. Exceeding the set number of attempts to enter an authorized PIN will also set the alarm. Alternatively, switch 13 on the remote controller 11 can be depressed which initiates the Disarm module.

In the Alarm mode piezo 8 is engaged to sound. In order to disable piezo 8, the user must enter an authorized PIN into the GUI via the laptop keyboard. Alternatively, switch 13 on the remote controller 11 can be depressed which initiates the Disarm module.

To operate alarm 1 the following procedure is used: The user starts the computer and then launches the alarm application program. A GUI (Graphical User Interface) will appear on the computer monitor. The user decides on a four digit PIN (Personal Identification Number). The user then enters the number (via the laptop keyboard) into the space provided on the right-hand side of GUI. The user may now change the factory pre-sets for the Disarm Attempts, Disarm Time, Arming Delay and Sensitivity.

In order to arm the alarm using the GUI, the user enters the same PIN into the left-hand side of the GUI under the "Commands" heading. The alarm will move to the Armed state as evidenced by the now highlighted Arm icon. To disarm the alarm the user retypes the PIN into the space provided on the Command side and the alarm will move to the Disarmed state as evidenced by the now highlighted Disarm icon. If the user forgets his PIN, he may select a new one by deliberately setting off the alarm nine times in succession. This is preferably accomplished by using the arm 12 and disarm 13 switches on the remote control 11. This routine clears the previous PIN and allows the user to enter a new one. The advantage is that the user may regain the use of the alarm without having to contacting the alarm vendor. This option can be deselected by checking the "Med. PIN Security" box 55 or selected by checking the "Max. PIN Security" box 56 located in the lower section of the GUI.

Figure 9:
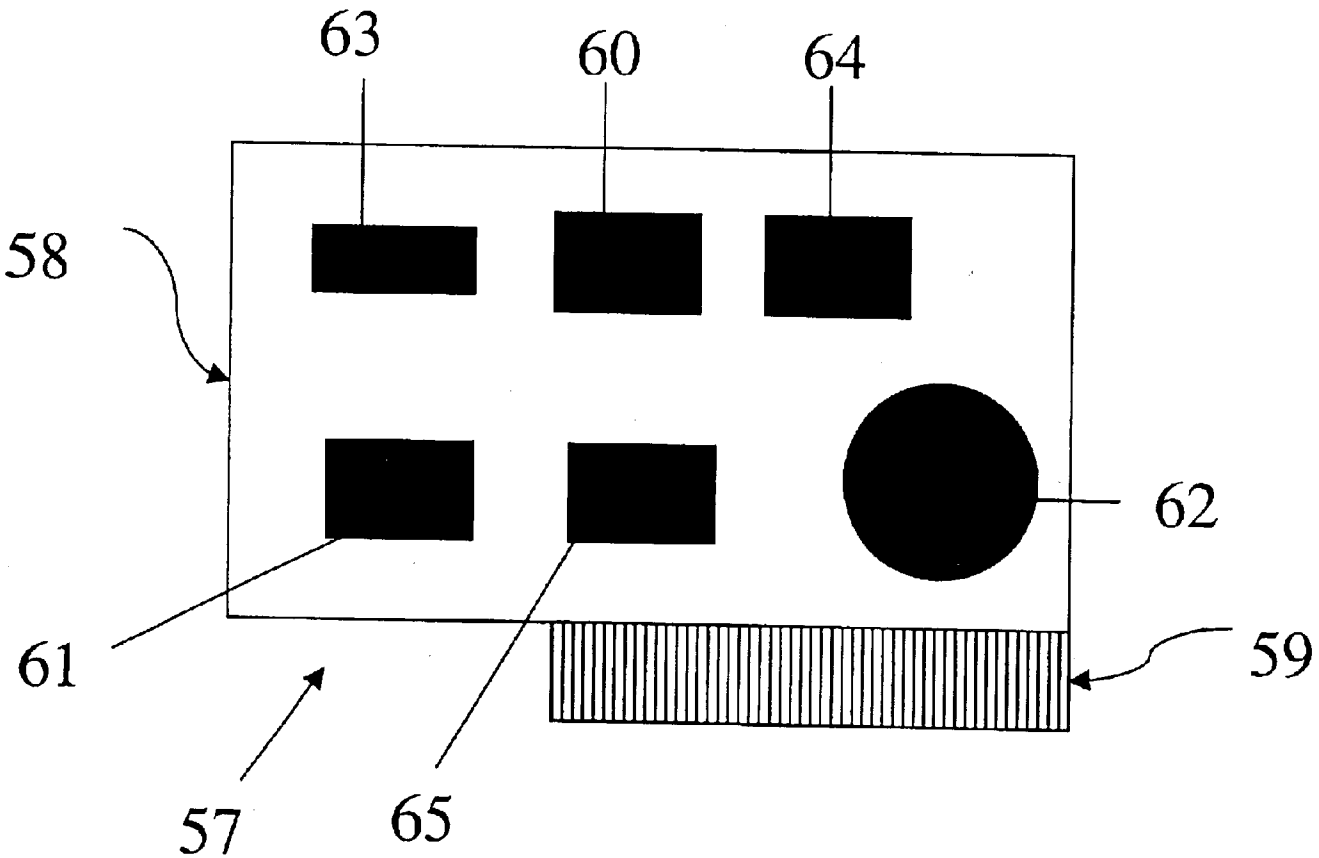
FIG. 9 is a schematic representation of another embodiment of the internal micro alarm of the present invention on a PCI Card.

FIG. 9 shows another embodiment of the alarm system of the present invention, generally indicated at 57, mounted on a PCI card 58 for installation into desk-top computers and network servers. The PC communicates with the alarm via the PCI bus connector 59. Installed on the PCI card 58 are microcontroller 60, motion sensor 61, piezo siren 62, transformer 63, drive transistor 64 and rechargeable battery 65 as well as support circuitry. In the preferred embodiment the alarm parameters are adjustable by a GUI under the Windows operating system.

Figure 11:
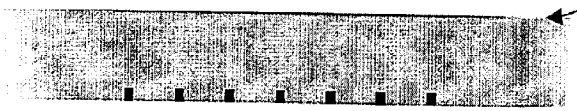
FIG. 11 shows the hybrid circuit board of FIG. 10 placed in a protective case.
Figure 10:
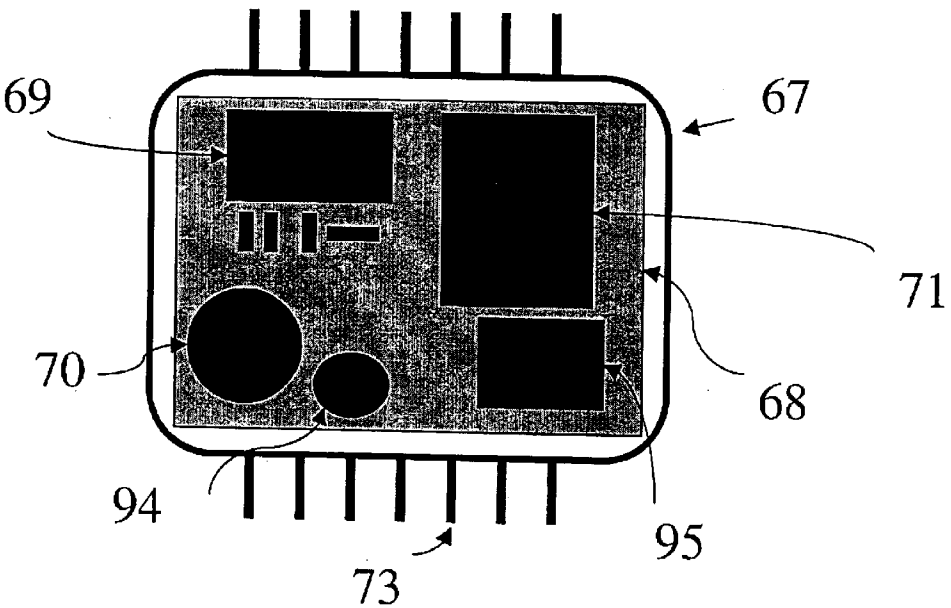
FIG. 10 is a schematic representation of another embodiment of the internal micro alarm mounted on a hybrid circuit board.

FIGS. 10 and 11 shows another embodiment of the alarm system of the present invention, generally indicated at 67, mounted on a hybrid circuit board 68 for automated insertion onto a PCB. This will allow the alarm to be integrated into and protect any equipment that is designed with a circuit card. Examples would be HDTV's, professional and consumer audio systems, medial equipment, laboratory equipment, vehicle electronics and weapons systems. The hybrid circuit board 68 upon which the circuit elements are mounted is preferably fiberglass or ceramic. Contained on the hybrid circuit board 68 are microcontroller 69 (and support circuitry), motion detector 70, piezo driver 94, transformer 95 and rechargeable battery 71. The hybrid circuit board 68 is place into protective case 72. Metallic leads 73 allow a soldering connection between the alarm hybrid assembly and the host PCB. The piezo siren would be mounted in the equipment housing and connected to the host PCB by fly leads (wires).

The waveform that drives the piezo element helps achieve a piercing and deafening sound that is irritable to the human ear. The output waveform is preferably sinusoidal with a center frequency matched to the fundamental resonant frequency of the piezo element resulting in the piezo emitting a two-tone warble. At 120 dBs this is sufficient to startle the intruder causing him to place the laptop down and leave the immediate area. The Piezo siren is programmed to sweep frequencies in the following manner: Start frequency 4400 Hz, end frequency 4800 Hz with a rate of change of frequency of 10 Hz. This has been determined to generate an irritable sound to the human ear.

Figure 12:
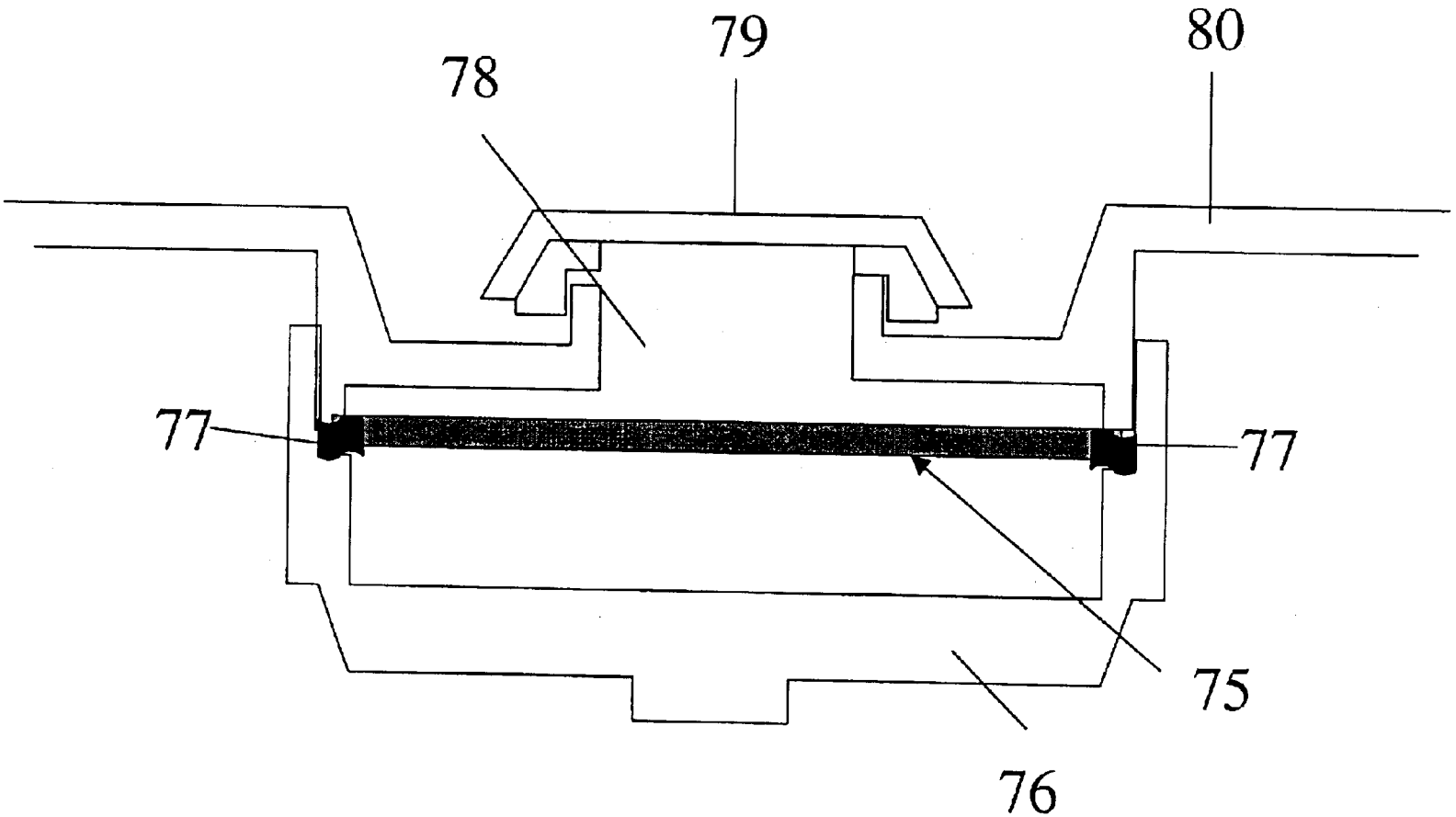
FIG. 12 is a schematic representation in cross section of an embodiment of a piezo siren of the present invention

FIG. 12 details the preferred mounting of the piezo element 75. In the embodiment shown a 27 mm (1.063")

diameter piezo element 75 with a resonant frequency of 4.6 kHz was used. To achieve maximum sound volume the piezo element 75 was firmly glued to cap 76 with minimum edge support. The cap 76, in the embodiment shown, was constructed from ABS plastic to which the piezo element 75 was bonded using a thin coating of cyanoacrylate glue. A complete but minimal support of the edges 77 of the piezo element allows for maximum throw and hence maximum sound pressure level. The acoustic chamber 78 was also designed to be resonant to the fundamental frequency of the piezo element. The acoustical impedance of the piezo element and the enclosed air was also matched by the design of a sound cone 79 and cap 76. In the embodiment shown in FIG. 12, the laptop case 80 becomes part of the piezo acoustic assembly. This reduces the space require to house the piezo and makes the piezo housing an integral part of the laptop case 80. It is not essential that the case become part of the piezo acoustic assembly and in most cases it won't.

A sound level of 120 dBs was achieved by over-driving the piezo electro-acoustic element beyond the specified maximum for a period of not more than three minutes. The piezo element was driven with a 300-volt alternating current waveform. To further reduce any constriction of the movement of the piezo element a thin, 28-gauge multi-strand wire was used to make the electrical connection between the transformer and the piezo element. In order to avoid damage to the piezo element a soldering time was limited to 0.5 seconds on the ceramic side and 2.0 seconds on the metal side of the piezo element.

Figure 13:
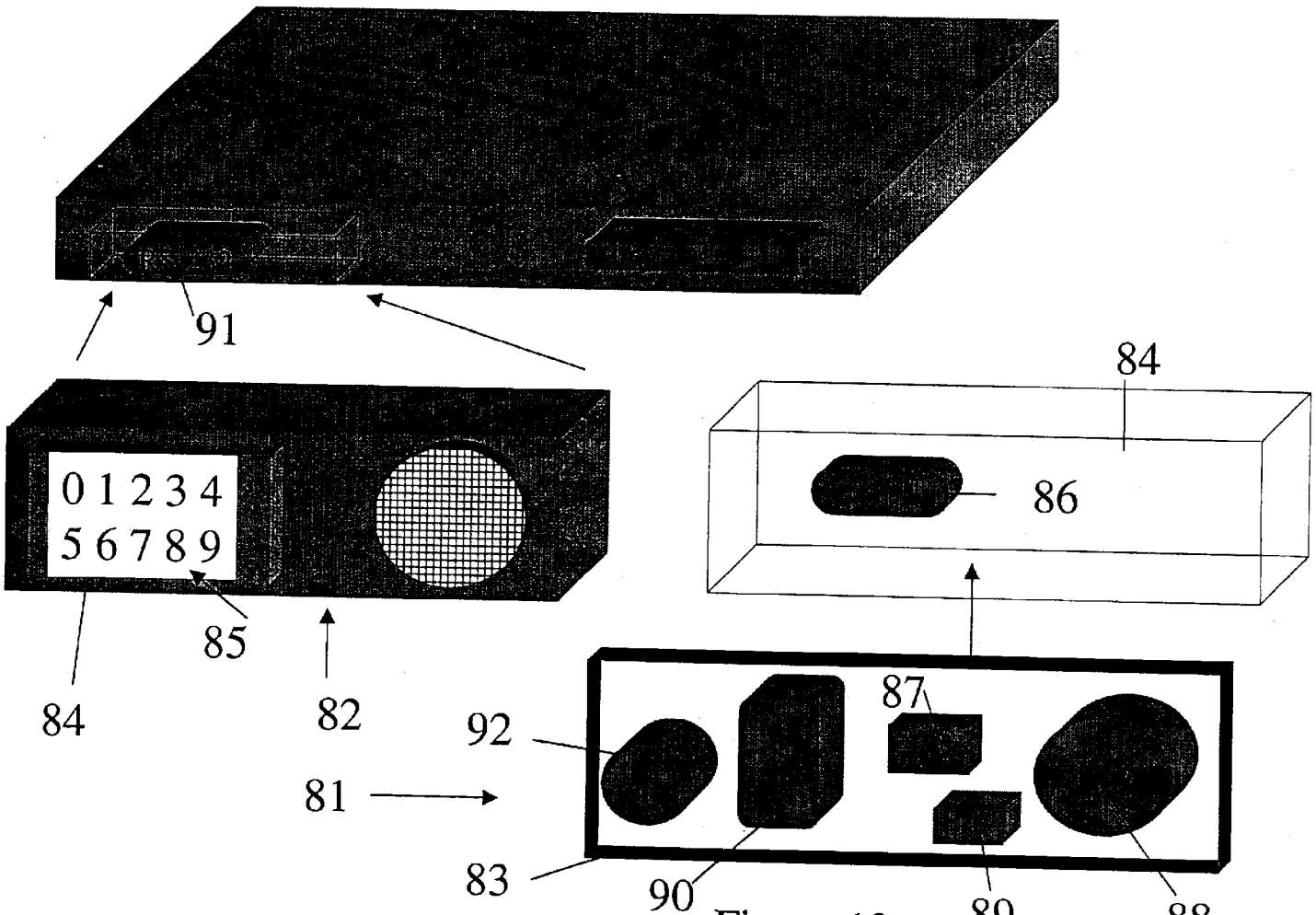
FIG. 13 is a schematic representation of another embodiment of the internal micro alarm of the present invention mounted externally to a laptop RS-232 port.

FIG. 13 shows a further embodiment of the alarm system of the present invention, generally indicated at 81 mounted inside a serial port dongle 82. The main components of the dongle are PCB 83, plastic housing 84, keypad 85 and 9-pin D-type connector 86. A microcontroller 87, piezo siren 88, transformer 89, battery 90, sensor 92 keypad 85 and discrete electronics devices are mounted on the PCB 83. The dongle 82 can be attached to a laptop computer or other devices to be protected by fastening it with screws to the available serial (RS-232) port 91. This allows the motion detector alarm system to be adapted to legacy equipment. The alarm can be set by entering A PIN number via the keypad or by the GUI. As in the fully internally mounted alarm the Windows GUI is used to set disarm-attempt, arm-time and motion-detection sensitivity.

The advantage of the internal alarm is that the laptop, PC or other item cannot be moved when armed. Unauthorized movement will cause the alarm to sound. This provides a deterrent to theft even if the laptop, PC or other item is not being otherwise monitored. The basis of this alarm is that the intruder would be startled by the piezo alarm and would likely set the laptop, PC or other item down and retreat from the area. Further if he chose to move about with the laptop (alarm sounding) he would immediately become under the scrutiny of employees or security personnel. In a deserted environment the sound of the alarm (preferably 120 dBs two-tone warble) would eventually force the intruder to retreat or to waste time trying to disarm the unit. In a typical scenario, security or police would arrive after 3–5 minutes. This does not allow the intruder much time and it is likely that he would leave the laptop, PC or other item and attempt to steal something else or simply leave before the 3–5 minute window had expired.

The sensor of the present invention is an electro-mechanical device, which responds to motion in two axes. The sensor is simple and robust. It has advantage over other sensor technologies.

Although various preferred embodiments of the present invention have been described herein in detail, it will be appreciated by those skilled in the art, that variations may be made thereto without departing from the spirit of the invention or the scope of the appended claims.

The embodiment of the invention in which exclusive property or privilege is claimed are defined as follows:

1. An electro-mechanical motion sensor for detecting the unauthorized movement of an object and which responds to motion in all axes, said sensor comprising a housing having a base, cap and peripheral wall defining the interior of said housing wherein said base and cap have internal and external surfaces with a mid-point thereon and a series of radially extending electrical contacts on the internal surfaces of the base and cap, said contacts extending from about said mid point of said base and cap, wherein a metallic post is located between the mid points on the base and cap respectively and wherein a metallic ball is provided within the housing and is of sufficient size that it can roll freely within the interior of said housing always in contact with said radially extending contacts, peripheral wall or metallic post wherein said metallic ball will tend to come wrest in a position against said metallic post or peripheral wall while touching one or more of said radially extending contacts such that an electrical circuit is formed by contact between said metallic ball and said metallic post or peripheral wall and said radially extending contacts wherein the radially extending contacts, peripheral wall, metallic post and metallic ball are gold plated.

2. An electro-mechanical motion sensor according to claim 1 in combination with a programmable control microprocessor, to detect when said electrical circuit is formed by said peripheral wall or metallic post, metallic ball and any radially extending contacts and to detect when said circuit is broken.

3. An electro-mechanical motion sensor according to claim 2 in combination with an audible alarm means wherein said audible alarm means emits a sound oscillating between at least two frequencies and at a volume of about 120 dBs when the electrical circuit formed by the peripheral wall or metallic post, metallic ball and any radially extending contacts is broken.

4. An electro-mechanical motion sensor according to claim 2 or 3 wherein the programmable control microprocessor is activated, deactivated or programmed by means of a remote control.

5. An alarm means for detecting the unauthorized movement of an object, wherein said alarm means is located on laptop (or desktop) computer motherboard or otherwise located internally to a computer. TV, HDTV. VCR, video recorder, audio home entertainment system or similar valuable electronic equipment said alarm means comprising:

(a) a motion detection means comprising an electro-mechanical motion sensor for detecting the unauthorized movement of an object and which responds to motion in all axes, said sensor comprising a housing having a base, cap and peripheral wall defining the interior of said housing wherein said base and cap have internal and external surfaces with a mid-point thereon and a series of radially extending electrical contacts on the internal surfaces of said base and cap, said contacts extending from about said mid point of said base and cap, wherein a metallic post is located between the mid points on the base and cap respectively and wherein a metallic bull is provided within the housing and is of sufficient size that it can roll freely within the interior of said housing always in contact with said radially extending contacts, peripheral wall or metallic post wherein said metallic ball will tend to come to rest in a position against said metallic post or peripheral wail while touching one or more of said radially extending contacts such that an electrical circuit is formed by contact between said metallic ball and said metallic post or peripheral wall and said radially extending contacts wherein the radially extending contacts, peripheral wall, metallic post and metallic ball arc 24 karat gold plated;

(b) a programmable control microprocessor, to detect when said electrical circuit is formed by said peripheral wall or metallic post, metallic ball and any radially extending contact and to detect when said circuit is broken by movement of the object;

(c) an audible alarm means wherein said audible alarm means emits a sound oscillating between at least two frequencies and at a volume of about 120 dBs when said electrical circuit is broken; and (d) a rechargeable battery and wherein the said microprocessor, audible alarm means, rechargeable battery and motion detection means are mounted on a circuit board.

6. The alarm means of claim 5 wherein a means for sensitivity adjustment is provided for the motion detection means.

7. The alarm means of claim 6 wherein the means for sensitivity adjustment fixes the number of times the electrical circuit is broken by motion of the ball before the alarm means is sounded.

8. The alarm means of claim 7 wherein the sensitivity adjustment means includes a set time period in which the electrical circuit is broken two or more times before the alarm means is sounded.

9. The alarm means of claim 5 wherein the alarm means can be activated or deactivated by means of a remote control.

10. The alarm means of claim 9 wherein the remote control includes means to activate the alarm means so that the object to which the alarm means is attached can be located within a radius of approximately 100 feet.

11. The alarm means of claim 5 attached directly to the motherboard of a computer.

12. The alarm means of claim 5 mounted on a hybrid circuit board for automated insertion onto a printed circuit board, wherein the microprocessor, motion detection means, audible alarm means and rechargeable battery are mounted on said hybrid circuit board and said hybrid circuit board includes means to allow a soldering connection between the hybrid circuit board and said printed circuit board.

13. The alarm means of claim 5 mounted on a PCI card for installation into desk-top computers and network servers.

14. The alarm means of claim 5 adapted to include a fuzzy-logic based feature to auto-arm the alarm means based on a history of the user's habit of arming the alarm means.

15. The alarm means of claim 5 wherein the alarm means is activated or deactivated by means of a pin number (PIN) and said alarm means is adapted to include means for clearing a PIN and installing a new one in the case of a forgotten PIN.

16. The alarm means of claim 5 mounted inside a serial port dongle.

* * * * *